United States Patent [19]

Kleeblatt

[11] Patent Number: 5,011,051

[45] Date of Patent: Apr. 30, 1991

[54] METALLURGICAL VESSEL SLIDE VALVE

[75] Inventor: Schmuel Kleeblatt, Strassen, Luxembourg

[73] Assignee: Cerafer S.A.R.L. Co., Luxembourg

[21] Appl. No.: 424,097

[22] Filed: Oct. 20, 1989

[30] Foreign Application Priority Data

Oct. 20, 1988 [DE] Fed. Rep. of Germany ..... 3835687

[51] Int. Cl.[5] ..... B22D 37/00

[52] U.S. Cl. ..... 222/600; 222/591

[58] Field of Search ..... 222/600, 591; 266/236

[56] References Cited

U.S. PATENT DOCUMENTS

| | | | |
|---|---|---|---|
| 3,912,134 | 10/1975 | Poran | 222/600 |
| 4,415,103 | 11/1983 | Shapland et al. | 222/600 |
| 4,660,749 | 4/1987 | Yokoi et al. | 222/600 |
| 4,697,723 | 10/1987 | Fricker | 222/600 |

FOREIGN PATENT DOCUMENTS 1093478 12/1967 United Kingdom .

*Primary Examiner*—S. Kastler

*Attorney, Agent, or Firm*—Fulbright & Jaworski

[57] ABSTRACT

A slide valve for the spout of metallurgical pouring vessels may exhibit a closure plate fixedly mounted on the vessel and a slide plate of a refractory material. Each plate is provided with a passage bore for the metallurgical melt. The slide plate is guided by guide rails on spring supported contact rails in a displaceable manner. The plates slide with their facing closure surfaces on each other. The closure plate passage bore and the sliding plate passage bores may be aligned to open the valve. The contact rails are held freely on a spring supported axle against the contact pressure direction and extend transversely to the center line of the closure plate passage bore. Each slide plate guide rails has a curvature or apex directed against a contact rail. The effective contact length of the contact rails is greater than the distance measured in the sliding direction between the guide rail culmination points of two successive slide plates, but smaller than the distance of the outer culmination points of three successive plates. The contact rails exhibit chamfered inlet zones on both sides of their effective contact length.

15 Claims, 5 Drawing Sheets

METALLURGICAL VESSEL SLIDE VALVE

BACKGROUND OF THE INVENTION

1. Field of the Invention

The invention relates to a slide valve and more particularly to a metallurgical vessel slide valve having a rail guided slide plate.

2. Description of the Related Technology

GB No. 1 093 478 corresponds to U.S. Pat. application Ser. No. 453,730, the disclosures of which are expressly incorporated herein, and shows a slide valve where the slide plates are equipped with planar guide rails and the contact plates are fastened by a plurality of dual arm levers. The free lever arm is exposed to the action of a compression spring. The disclosed slide valves are unable to assure the satisfactory closure of the vessel in operation. In actual operation, contact plate and guide plate warping in excess of manufacturing tolerances cannot be prevented. The metallurgical melt contained within the vessel exerts pressure on the plates. In view of the contact pressures applied over the entire length of the contact plate and the warping effect, a unilateral lifting of the slide plate from the closure plate cannot be excluded with adequate assurance. Replacement of used slide plates and installation of new plates require a considerable effort.

SUMMARY OF THE INVENTION

It is an object of the present invention to provide a slide valve to insure safe closure of metallurgical vessels. This object may be attained by a slide valve for a metallurgical pouring vessel spout. A closure plate is fixedly mounted on the vessel. The closure plate and a slide plate made of refractory material each exhibit passage bores for the metallurgical melt. The slide plate has guide rails which are displaceable along spring supported contact rails. The plates slide with closure surfaces facing and contacting each other. Moving the slide plates may align the passage bores or block the opening. The contact plates or rails are held freely on an axle or pivot. The axle is spring supported against the direction of contact pressure and extends transversely to the center line, M1, of the passage bore. The slide plate guide rails exhibit a curvature directed against the contact rails.

The contact pressure in a slide valve according to the invention is not applied in numerous locations distributed over the entire length of the contact plate. The contact pressure is advantageously applied in only a single location by the mechanism of a counter curvature of the slide plate guide rail, in combination with a free rocker-like or pivot support for the contact plate on an axle. The axle is aligned in the center plane of the passage bore and insures that contact pressure always acts only on one location or line on the plates. This structure allows for increased manufacturing tolerances or differences in thickness caused by the processing of used plates. The effects of any differences are minimized without interference with the system or loss of closing force. In applications which exclusively utilize plates with passage bores, the guide rail curvature may be outside the center of the plate. The culmination point of the curvature may conveniently be located in the center plane of the plates where a mixed set of closed plates and plates exhibiting a passage bore is utilized.

According to a feature of the invention, the guide rail culminating point is located outside the center plane of the passage bore in the area of the closure surface of the slide plate. A plurality of slide plates may be held in succession to each other, and one of the plates may be a closed plate, i.e., without a passage bore. The effective contact length or effective zone of the contact rails may be greater than the distance, measured in the slide direction, between the culminating points of the guide rails of two successive slide plates, but smaller than the distance of the outer culminating points of three successive plates. When the plates exhibit centered culmination points, the distance corresponds at least to the length of a slide plate and at most to the total length of two successive slide plates. The contact rails advantageously may exhibit chamfered inlet zones on both sides of the effective contact length or zone.

The slide valve may have a three-plate slide, including a stationary closure plate mounted on the vessel, a slide plate adjacent to the closure plate, and a second stationary plate held against the slide plate by a clamping frame. The clamping frame may be fastened directly to the valve housing by an articulation. The clamping frame may be held by articulated holding shackles which in turn are mounted on the valve housing. The stationary plate may be curved in the direction perpendicular to the pivoting axle of the clamping frame, so that the culmination line, defined by the rail culmination points, intersects the center axis of the melt passage bore. The clamping frame may be articulated by an axle through a hinged bushing. The bushing may exhibit a centered, bilateral expanding bore configured as intersecting truncated cones. The clamping frame may be made up of a sectional frame and a sectional rail mounted on the stationary plate or on a support holding the stationary plate, and extending from either side from the passage bore.

The clamping frame may be configured as a plate containing a passage bore for the melt.

Further embodiments and advantages will become apparent from the following description in which the invention is explained by examples with reference to the drawing.

DETAILED DESCRIPTION OF THE PREFERRED EMBODIMENT

Figure 1:
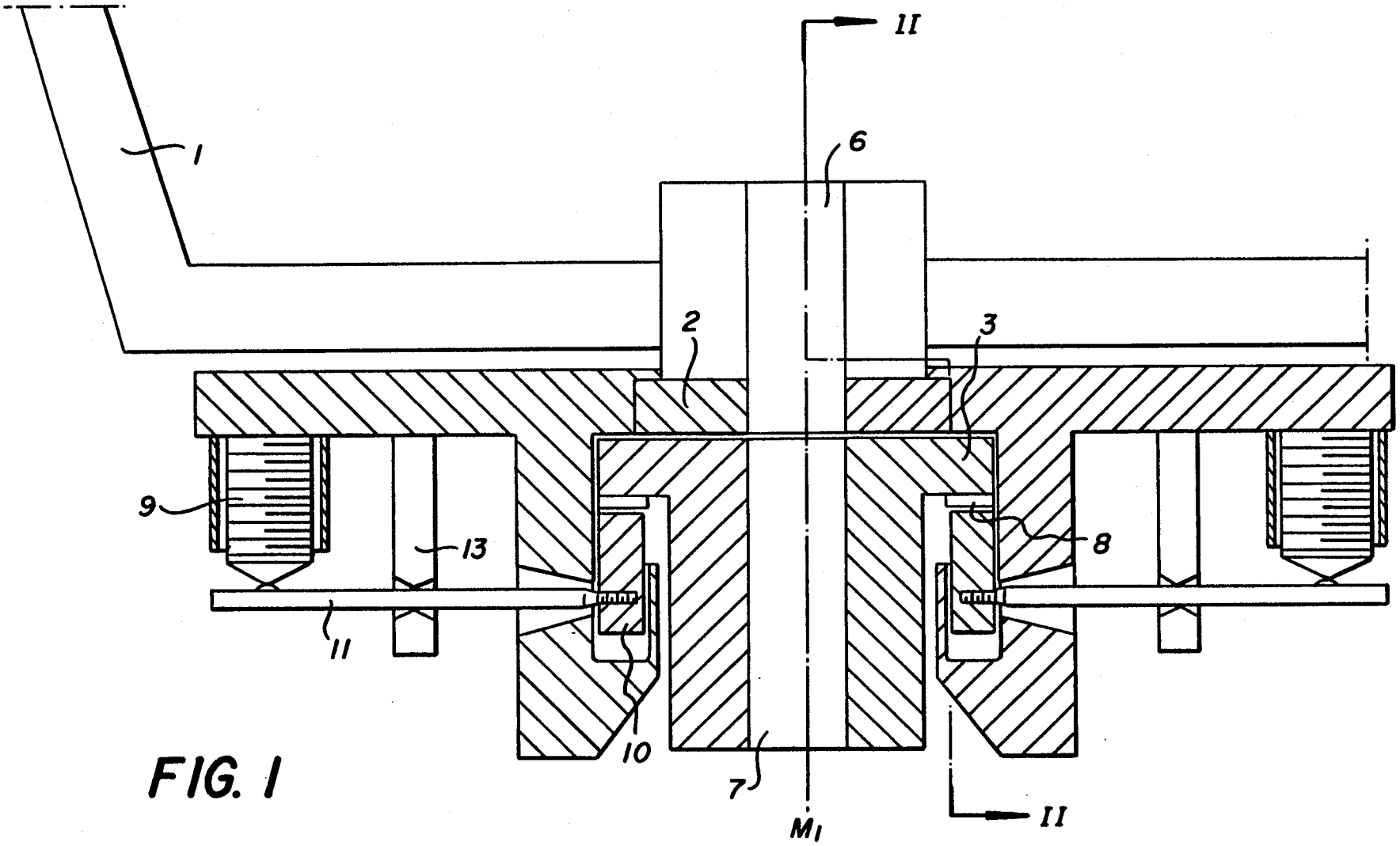
FIG. 1 shows a cross section of a slide valve.
Figure 2:
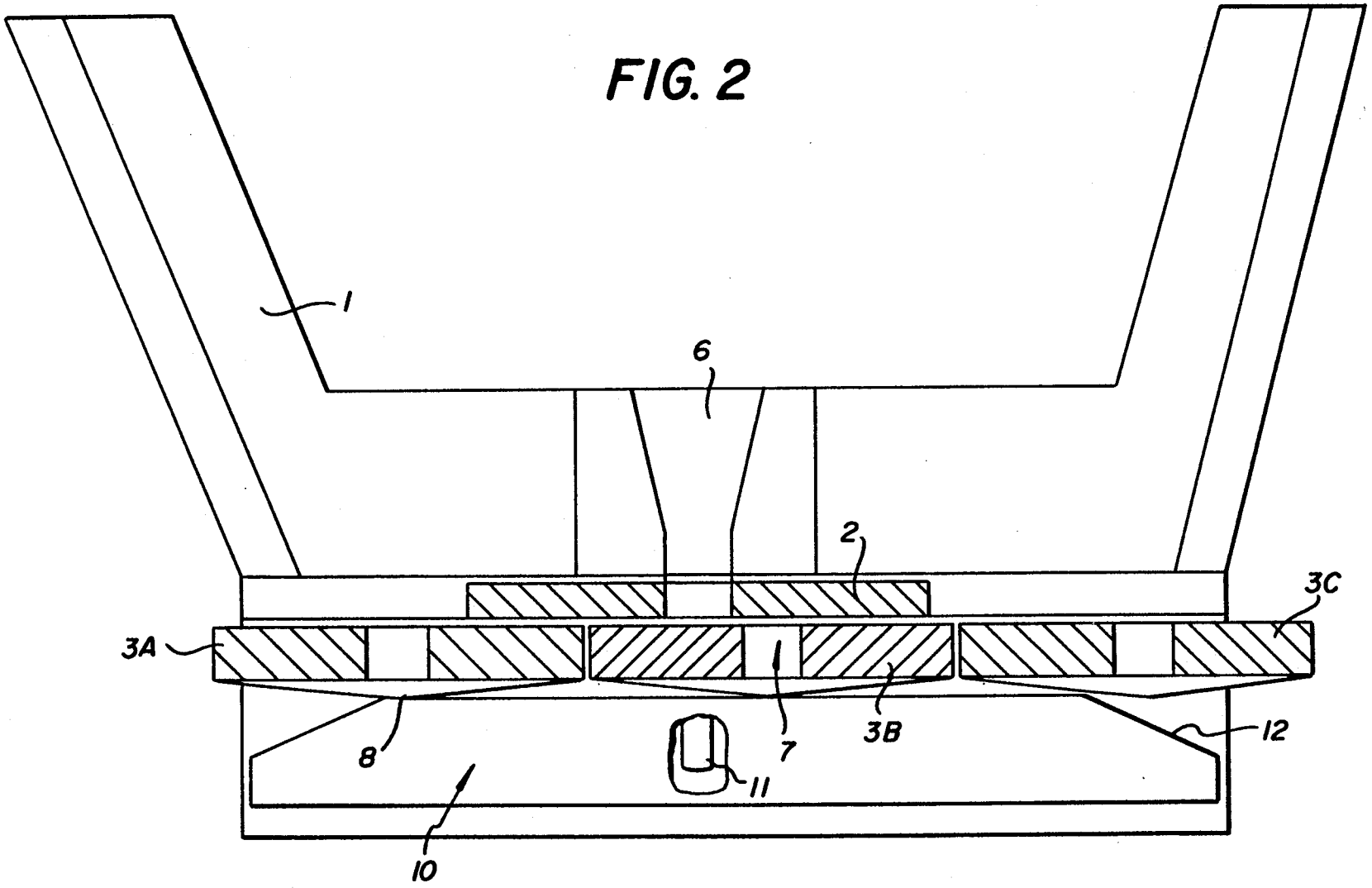
FIG. 2 shows a section of II—II through FIG. 1.
Figure 3:
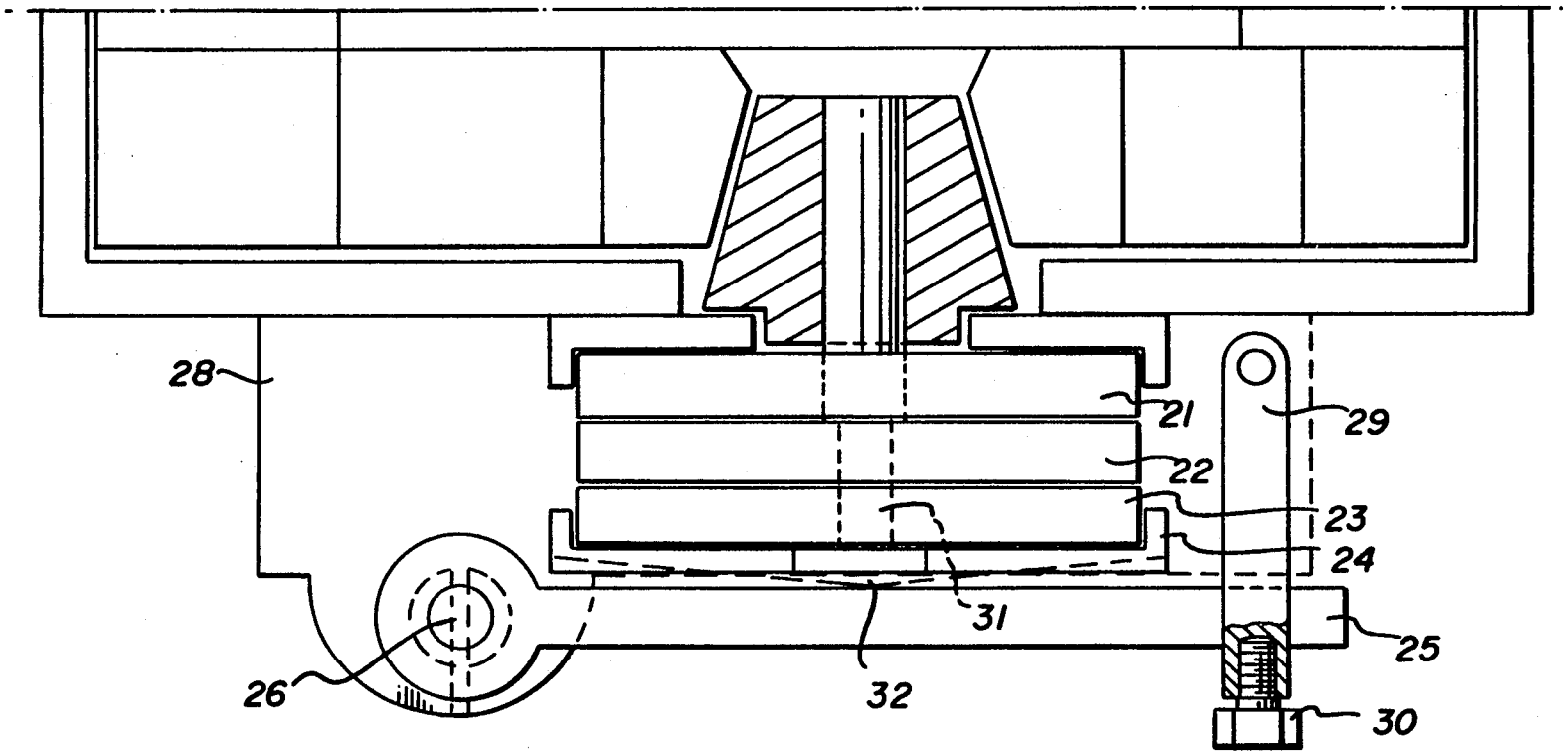
FIG. 3 shows a lateral elevation of a three-plate slide.
Figure 4:
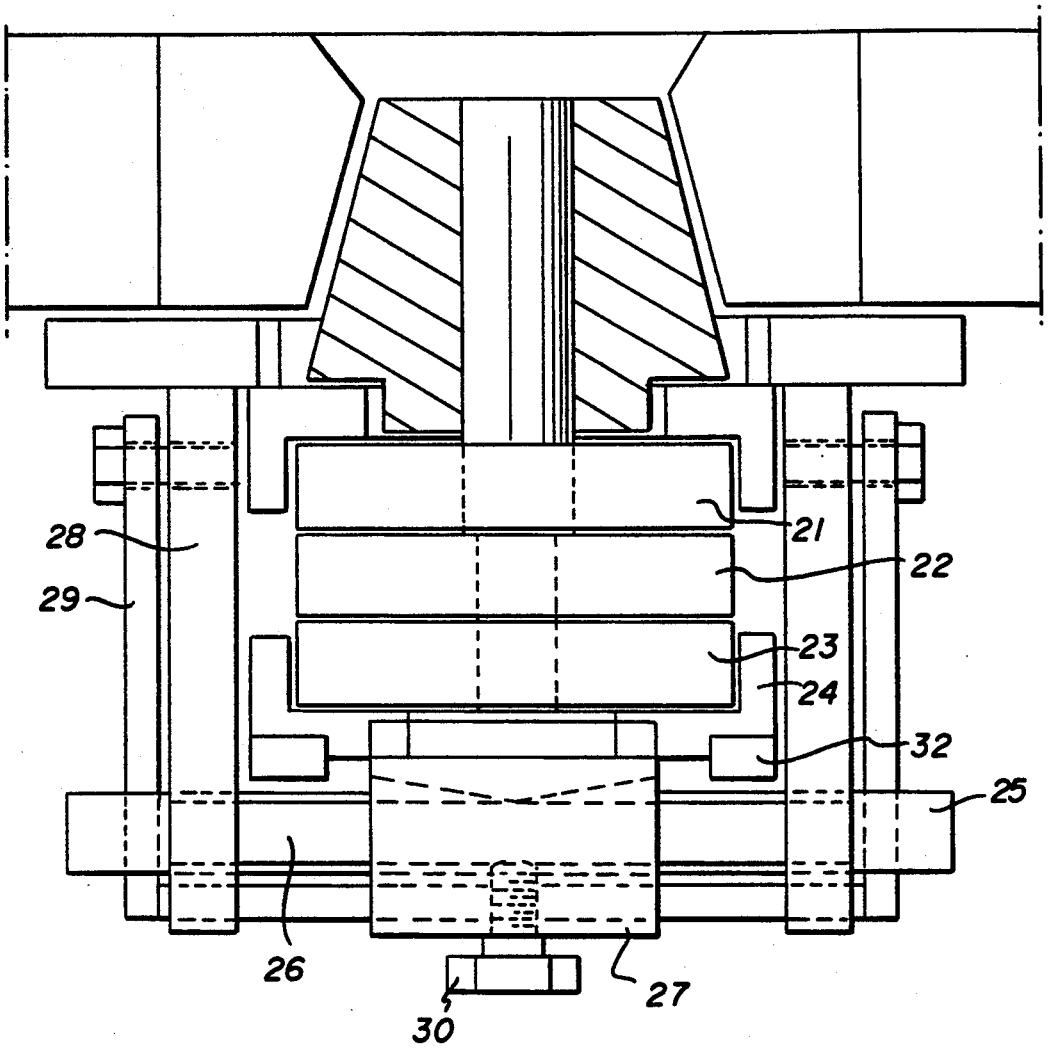
FIG. 4 shows a view of a partial section of the three-plate slide valve as viewed from the left in FIG. 3.
Figure 5:
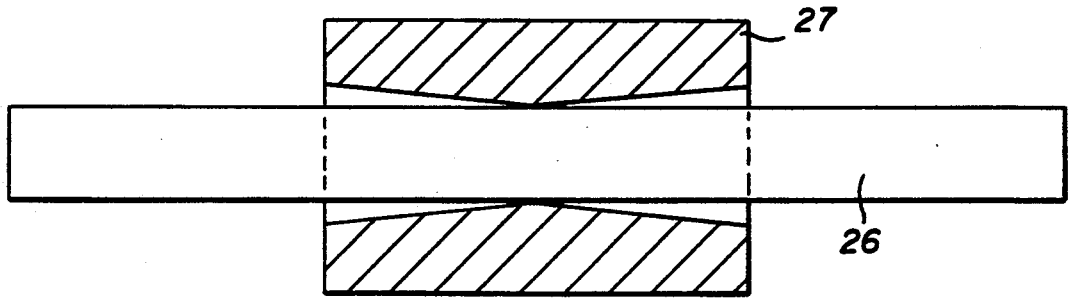
FIG. 5 shows an enlarged sectional view of the articulation for the clamping frame.
Figure 6:
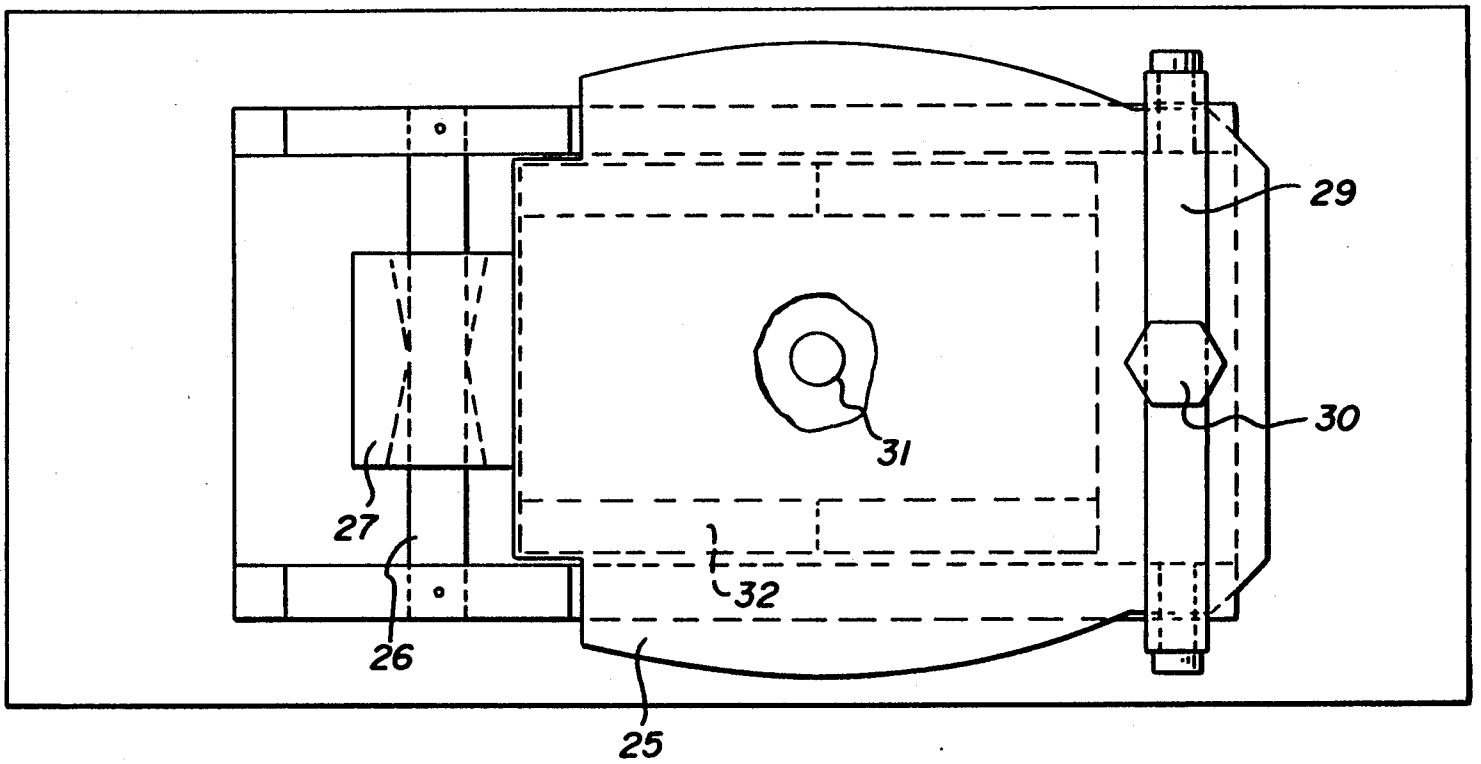
FIG. 6 shows a bottom view of FIG. 3.

The slide valve shown in FIGS. 1 and 2 for the spout of a metallurgical vessel 1 has a closure plate 2 fixedly mounted on the vessel and three successive slide plates 3A, 3B, 3C, in the sliding direction, made of a refractory material. The closure plate exhibits a passage bore aligned with a vessel bore 6. Each slide plate exhibits a passage bore 7 for the melt. The slide plates 3 are guided individually on guide rails 8 and are axially displaceable along spring supported contact rails 10, in a manner such that plates 2, 3 slide upon each other's facing surfaces. The passage bores 6, 7 may or may not coincide so that the closure plate passage bore 6 is covered by a closed area in front or behind of the slide plate as viewed in the sliding direction. A mixed set of plates may be provided instead of plates which each exhibit passage bores. One or more plates of the set are closed and only a single plate has an alignable passage bore 7. The contact rails 10 are held individually in a manner of a rocker on an axle or pivot 11. The axle 11 extends transversely to the center line M1 of the closure plate passage bore 6 and is spring supported in a bearing 13 against the contact pressure. In the example illustrated, the contact rail 10 is held on an axle 11 supported in the manner of a dual arm lever and is exposed to a spring 9 on its free end. Alternatively, the axle may be made of a spring material and be fixedly clamped at its free end, so that its spring action will result from its material properties. The guide rails 8 of the slide plate 3 exhibit a curvature directed against the contact rail 10. In the embodiment shown, the culmination line of the guide rails is located in the center plane of the slide plate passage bore 7. Alternatively, the guide rails may be located to increase the contact pressure in the area of the closure surface of the slide plate 3 outside the center plane of the passage bore 7.

In the illustrated embodiment, the slide plate has opposing lateral protrusion in an upper area acting as guide rails. The lower surface of the guide rails exhibits a convex or a pointed configuration. The lowest portion or apex of the guide rail configuration is referred to as the culmination point.

The contact rail 10 is maintained at a distance exceeding the thickness of the plate in the edge from the closure plate 2 due to the curvature of the slide plate guide rails 8. This clearance renders replacement of used plates extraordinarily simple. Replacement is effected by sliding out a used plate with a new one. This replacement, in contrast to all of the known slide valves, is possible even with a full vessel, i.e., in some cases even during the pouring operation. The rocker-like mounting of the contact rail, in combination with the curvature of the guide rail of the slide plates, assures secure contact of the slide plate effecting the closure. The direct abutment of adjacent slide plate surfaces assures satisfactory sealing of the outflow opening 6 during their passage even at the plate edges. It is merely necessary to insure that the effective contact length of the contact rails 10 is greater than the distance measured in the sliding direction between the culminating points of the guide rails of two successive slide plates and smaller than the distance of the outer culminating points of three successive plates.

In configurations utilizing a set of plates as shown in the drawing with a centered culminating points, the contact rail effective contact length must correspond to at least the length of a slide plate and at the most to the total length of two successive slide plates 3. To facilitate the threading in and the replacement of the plates, the contact rails 10 may be extended on either side of their effective contact length by chambered inlet zone 12. In such a case it is possible to maintain permanently three plates in the closure unit. Only one of the plates is in solid contact with the closure plate, while the other two are guided loosely in view of the curvature of the guide rails and the chamfering of the contact rails. The remaining plates are reserves in case of an unexpected breakthrough of the valve and transmit the slide force for displacement of the effective slide plate. The slide valve of the invention, therefore, considerably enhances the operating safety of the pouring of metallurgical melts.

The slide valve, according to the invention, operates as follows: FIG. 2 shows the valve in a closed position. The center slide plate 3B blocks the outflow opening 6 with a facial surface surrounding the passage bore 7. Other plates 3A and 3C are held in the valve in front and behind the active plate 3B as viewed in the slide direction. The culmination point of plate 3A is located in the effective range of the contact rail 10. The culmination point of slide plate 3C is outside the effective range of the contact rail. The culmination points of the plates 3A and 3B are located on opposite sides of the axle 11 within the effective length of the contact rail, so that both plates are pressed forcefully against the closure plate 2. Bridge formations by exterior plates and pressure relief of plate 3B is prevented as contact rail 10 will only contact the culmination points of two slide plates at any time. This eliminates the effect of differences in the thickness of the plates.

To open the slide valve, the plates are displaced together toward the left until the bores 6 and 7 coincide. At the point of coincidence, the rail culmination point of the plate 3C arrives in the contact rail 10 effective zone. Simultaneously or immediately prior to this, the rail culmination point of plate 3A leaves the contact rail effective zone and the rail culmination point of the plate 3B passes by the axle 11, thereby moving from the right side to the left side of the rocker. The effective plate 3B is exposed to the maximum force in the closing direction and the contact rail is held in balance without forming a bridge between the outer plates 3A and 3C. Even during replacement of plates, only the culmination points of the rails of two immediately adjacent plates are located on either side of the effective length of the contact rail 10 at any given time. The third plate, now the plate 3C, is held loosely only with the culmination point of its guide rails outside the effective length of the contact rail 10. This same process takes place in the reverse direction if the vessel is to be closed by the return of the plates.

To replace a used closing plate it is merely necessary to displace the plates by inserting a new plate. Upon insertion of a new plate from the right, the existing plate 3A is ejected, existing plate 3B moves into the 3A position, and the present plate 3C moves into the 3B position. The newly inserted plate takes the present 3C position.

The three plate slide valve for metallurgical vessels shown in FIGS. 3 to 6 exhibits a stationary closure plate 21, a slide plate 22, and a second stationary plate 23. The second closure plate 23 is located in a support or carrier 24 and held by a clamping frame 25 against the slide plate 22. The clamping frame is articulated on one side by an axle 26 through a sleeve 27 directly to the slide of a slide housing 28. The clamping frame 25 is also held by a holding shackle 29 with a clamp screw 30, which in turn is articulated on the slide housing 28, against the slide plate 22. A rail 32 extending on either side of the passage bore 31 is provided on the carrier 24 for the stationary plate 23 parallel to the pivot axle 26. The rail forms a transverse bearing for the clamping frame corresponding to the culmination point of a curvature, so that the clamping frame and the support rest on each other on a straight line only, thereby distributing the clamping force applied uniformly over the entire plate. Any unilateral tilting in the longitudinal direction of the valve is reliably excluded. The hinge of the clamping frame is formed by an axle 26 and a hinged bushing 27 in order to prevent nonuniform pressures in the transverse direction. As the bearing for the axle 26, the bushing 27 exhibits a bore expanding to the outside in the shape of a truncated cone on either side of the center plane. The stationary plate is therefore supported pivotingly in its two essential planes, wherein the rail 32 constitutes a rocker in the longitudinal direction and, through the bearing 26, 27, a rocker in the direction perpendicular to the longitudinal direction. The effect is that an absolutely uniform distribution of the holding force over the entire surface of the plate, and thus absolute tightness, is assured, even if unavoidable thickness tolerances and other unevennesses are taken into consideration.

In the embodiment shown, the clamping frame 25 is formed by a section frame and the culmination line of a profiled rail fastened to the support 24. Alternatively, the clamping frame may be a curving plate of a roof-like configuration, containing a passage bore, or any other suitable means.

I claim:

1. A metallurgical vessel slide valve comprising:

a fixed closure plate defining a closure plate passage bore; a displaceable refractory material slide plate adjacent to and facing said closure plate defining a slide plate passage bore;

guide rails each exhibiting a bearing culmination point connected to said slide plate;

spring supported contact rails positioned to support said guide rail bearing culmination points;

an axle pivot supporting each contact rail aligned transversely to an axis of said closure plate passage bore and connected to support springs.

2. A slide valve according to claim 1, wherein said guide rails are configured so that the culmination point of said guide rails is positioned outside a center plane of said closure plate passage bore in an area of a slide plate closure surface.

3. A slide valve according to claim 1, further comprising a plurality of slide plates successively arranged wherein one of said plates is a boreless plate.

4. A slide valve according to claim 3 wherein an effective zone of said contact rails is a length of said contact rails which is spaced at a distance approximating a width of said guide rails at said culmination point from a plane defined by a facing surface of said closure plate;

said effective zone exhibits a length greater than a distance between culmination points of adjacent slide plates and less than twice said distance.

5. A slide valve according to claim 4, wherein said contact rails further comprise chamfered inlet zones adjacent to said effective zone.

6. A metallurgical vessel slide valve comprising:

a stationary closure plate mounted on a vessel;

a slide plate adjacent to and facing said first stationary closure plate;

a second stationary plate adjacent to and facing said slide plate;

a clamping frame articulated to a housing of said slide valve, wherein said second stationary plate and said clamping frame are configured to meet at culmination points on lateral frame members;

a holding shackle connected to said clamping frame and articulated to said valve housing.

7. A slide valve according to claim 6, wherein said first and second stationary plates define passage bores; and said culmination points are positioned so that a line defined between said culmination points intersects a flow path of said passage bore.

8. A slide valve according to claim 7, further comprising a hinge bushing, defining a central bilaterally expanding truncated cone passage, connected to said valve housing; and said clamping frame further comprising at least an axle extending through said bushing passage.

9. A slide valve according to claim 8, further comprising an adjustable clamp screw connected to said holding shackle.

10. A slide valve according to claim 8, wherein said clamping frame further comprises a nonintegral rail exhibiting said culmination point adjacent to said second stationary plate.

11. A slide valve according to claim 8, wherein said second stationary plate further comprises a nonintegral support adjacent to said rail.

12. A slide valve according to claim 11, wherein said clamping frame further comprises a clamping plate exhibiting a material passage bore.

13. A slide valve according to claim 8, wherein said clamping frame further comprises a clamping plate exhibiting a material passage bore aligned with said stationary plate passage bores.

14. A slide valve according to claim 7, wherein said clamping frame further comprises a clamping plate exhibiting a material passage bore aligned with said stationary plate passage bores.

15. A slide valve according to claim 6, wherein said clamping frame further comprises a clamping plate exhibiting a material passage bore aligned with said stationary plate passage bores.

* * * * *